US008280084B2

(12) United States Patent
Latzel et al.

(10) Patent No.: US 8,280,084 B2
(45) Date of Patent: Oct. 2, 2012

(54) METHOD FOR SIGNAL PROCESSING FOR A HEARING AID AND CORRESPONDING HEARING AID

(75) Inventors: Matthias Latzel, Eggolsheim (DE); Andreas Tiefenau, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 355 days.

(21) Appl. No.: 12/685,084

(22) Filed: Jan. 11, 2010

(65) Prior Publication Data

US 2010/0177915 A1 Jul. 15, 2010

(30) Foreign Application Priority Data

Jan. 9, 2009 (DE) ..... 10 2009 004 185

(51) Int. Cl.
*H04R 25/00* (2006.01)

(52) U.S. Cl. ..... 381/312; 381/317; 381/318; 381/320

(58) Field of Classification Search ..... 381/312–313, 381/316–318, 320–321
See application file for complete search history.

(56) References Cited

U.S. PATENT DOCUMENTS

| | | | | |
|---|---|---|---|---|
| 6,198,830 | B1 * | 3/2001 | Holube et al. | 381/321 |
| 6,236,731 | B1 * | 5/2001 | Brennan et al. | 381/316 |
| 7,181,033 | B2 | 2/2007 | Fischer et al. | |
| 2007/0053535 | A1 | 3/2007 | Frieding | |
| 2007/0140512 | A1 | 6/2007 | Hain et al. | |

FOREIGN PATENT DOCUMENTS

| | | | |
|---|---|---|---|
| DE | 102005061000 | A | 6/2007 |
| EP | 1307072 | A2 | 5/2003 |
| EP | 1829028 | A1 | 9/2007 |
| WO | 2006058361 | A1 | 6/2006 |

* cited by examiner

*Primary Examiner* — Suhan Ni

(74) *Attorney, Agent, or Firm* — Laurence A. Greenberg; Werner H. Stemer; Ralph E. Locher

(57) ABSTRACT

A method for signal processing for a hearing aid aims to better match signal processing for a hearing aid and in particular a hearing device to a situation and includes processing an input signal in accordance with a first processing algorithm to form a first intermediate signal and processing the input signal in accordance with a second processing algorithm to form a second intermediate signal in parallel with the processing of the input signal in accordance with the first processing algorithm. The input signal is classified by a classifier. Finally, an output signal with a constant mixture ratio is formed both from the first and from the second intermediate signals, taking into account the result of the classification. This allows the advantages of a plurality of algorithms to be used at the same time. A corresponding hearing aid is also provided.

10 Claims, 5 Drawing Sheets

METHOD FOR SIGNAL PROCESSING FOR A HEARING AID AND CORRESPONDING HEARING AID

CROSS-REFERENCE TO RELATED APPLICATION

This application claims the priority, under 35 U.S.C. §119, of German Patent Application DE 10 2009 004 185.0, filed Jan. 9, 2009; the prior application is herewith incorporated by reference in its entirety.

BACKGROUND OF THE INVENTION

Field of the Invention

The present invention relates to a method for processing an input signal to form an output signal in a hearing aid by processing the input signal in accordance with a first processing algorithm to form a first intermediate signal and processing the input signal in accordance with a second processing algorithm to form a second intermediate signal in parallel with the processing of the input signal in accordance with the first processing algorithm. The present invention furthermore relates to a corresponding hearing aid having a first processing device and a second processing device. In that case, the expression "hearing aid" means any device which emits sound and can be worn on the head or in or on the ear, in particular a hearing device, a head set, headphones or the like.

Hearing devices are portable hearing aids which are used to supply those with impaired hearing. In order to satisfy numerous individual requirements, different forms of hearing aids are provided, such as behind-the-ear hearing aids, hearing aids with an external receiver (RIC: receiver in the canal) and in-the-ear hearing aids, for example concha hearing aids or canal hearing aids (ITE, CIC). The quoted examples of hearing aids are worn on the outer ear or in the auditory canal. Furthermore, however, bone conduction hearing aids are also commercially available, as are implantable or vibrotactile hearing aids. In that case, the damaged hearing is stimulated either mechanically or electrically.

In principle, the major components of hearing aids are an input transducer, an amplifier and an output transducer. The input transducer is generally a sound receiver, for example a microphone, and/or an electromagnetic receiver, for example an induction coil.

The output transducer is generally an electroacoustic transducer, for example a miniature loudspeaker, or an electromechanical transducer, for example a bone conduction hearing aid. The amplifier is normally integrated in a signal processing unit.

That basic structure is illustrated in FIG. 1, using the example of a behind-the-ear hearing aid. One or more microphones 2 for receiving the sound from the surrounding area are installed in a hearing aid housing 1 that is to be worn behind the ear. A signal processing unit 3, which is likewise integrated in the hearing aid housing 1, processes the microphone signals and amplifies them. An output signal from the signal processing unit 3 is passed to a loudspeaker or earpiece 4, which emits an acoustic signal. If required, the sound is transmitted through a sound tube, which is fixed through the use of an otoplasty in the auditory canal, to the eardrum of the hearing-aid wearer. A power supply for the hearing aid and in particular for the signal processing unit 3 is provided by a battery 5, which is likewise integrated in the hearing aid housing 1.

In general, a hearing-aid wearer uses his or her hearing aid in different acoustic situations, placing different requirements on the signal processing in the hearing aid. For example, when listening to music, a fairly linear setting with little compression and regulation of the hearing aid is successful, while a fairly non-linear setting, that is to say with compression, and with time constants which are as short as possible, has advantages for understanding speech, particularly in a noisy environment.

U.S. Patent Application Publication No. US 2007/0053535 A1 discloses a method for operation of a hearing aid. A signal from at least one signal source is recorded. At least one of these recorded signals is classified into one of a plurality of predefined sound classes. Characteristics of the sound source are taken into account in that process. Finally, a hearing program is selected corresponding to the classification result in the hearing aid.

Furthermore, European Patent Application EP 1 829 028 A1, corresponding to International Publication No. WO 2006/058361 A1, discloses a method for adaptive matching of a sound processing parameter. The input signal is processed so as to achieve a specific dynamic range. In that case, a measured dynamic range is matched to a nominal dynamic range by appropriately setting the gain.

Furthermore, European Patent Application EP 1 307 072 A2, corresponding to U.S. Pat. No. 7,181,033, discloses a hearing aid in which disturbing acoustic effects caused by switching processes are intended to be avoided. For that purpose, the signal processing in the hearing aid merges smoothly from a first operating mode into a second operating mode. Both operating modes are therefore present at the same time in the hearing aid during the switching process. The smooth transition is carried out by parallel signal processing in at least two signal paths in the hearing aid, with a signal which results from the first operating mode and a signal which results from the second operating mode being added with alternating weighting.

Furthermore, German Published, Non-Prosecuted Patent Application DE 10 2005 061 000 A1, corresponding to U.S. Patent Application Publication No. US 2007/0140512 A1, discloses signal processing for hearing aids using a plurality of compression algorithms. The input signal is classified with respect to the current hearing situation in order to provide situation-dependent improvement of the signal processing. The input signal is amplified on the basis of a first compression algorithm or a second compression algorithm depending on the classification result. This makes it possible to make use of the respective advantages of the various compression algorithms in the individual hearing situations.

SUMMARY OF THE INVENTION

It is accordingly an object of the invention to provide a method for signal processing for a hearing aid and a corresponding hearing aid, which overcome the hereinafore-mentioned disadvantages of the heretofore-known methods and devices of this general type and which allow the signal processing for a hearing aid to be better matched to a situation.

With the foregoing and other objects in view there is provided, in accordance with the invention, a method for processing an input signal to form an output signal in a hearing aid. The method comprises processing the input signal in accordance with a first processing algorithm to form a first intermediate signal, processing the input signal in accordance with a second processing algorithm to form a second intermediate signal in parallel with the processing of the input signal in accordance with the first processing algorithm, classifying the input signal, and forming the output signal both from the first and from the second intermediate signals with a mixture ratio dependent on a result of the classifying step.

With the objects of the invention in view, there is also provided a hearing aid, comprising a first processing device for processing an input signal in accordance with a first processing algorithm to form a first intermediate signal, a second processing device for processing the input signal in accordance with a second processing algorithm to form a second intermediate signal in parallel with the processing of the input signal in accordance with the first processing algorithm, a classification device for classification of the input signal, and a third processing device for forming an output signal both from the first and from the second intermediate signals with a mixture ratio dependent on a result of the classification.

It is therefore advantageously possible to mix different signal processing algorithms as required in order to allow better matching to a specific hearing situation. In particular, this allows a mixture ratio of the output signals from the processing algorithms to be controlled by the classification result.

In accordance with another feature of the invention, in the first processing algorithm, regulation preferably takes place at the level of the input signal, and in the second processing algorithm, regulation preferably takes place at the level of the second intermediate signal. For example, the use of the level of the input signal makes it possible to regulate the compression rate, the gain or a time constant. In contrast, the use of the level of the second intermediate signal makes it possible to regulate the frequency-dependent gain.

In accordance with a further feature of the invention, in particular, the first or the second processing algorithm may each be a compression algorithm. In this case, it may be particularly advantageous for the first processing algorithm to be a linear compression algorithm (long time constant, for example 10 s) and for the second processing algorithm to be a non-linear compression algorithm (considerably shorter time constant, for example 10 ms), at least in a predetermined time period. This allows the compression to be matched very exactly to a specific situation.

In accordance with an added feature of the invention, the first processing algorithm may have a first time constant and the second processing algorithm may have a second time constant of a type which corresponds to that of the first time constant, with the first time constant not being the same as the second time constant. This makes it possible to use different time constants in the hearing aid, depending on the situation.

In accordance with a concomitant feature of the invention, the first processing algorithm may be based on a broadband level measurement, and the second processing algorithm may be based on a narrowband level measurement. This allows both broadband signal processing and narrowband signal processing to be included in an output signal at the same time. Furthermore, the first processing algorithm may be input-related, and the second output-related.

Other features which are considered as characteristic for the invention are set forth in the appended claims.

Although the invention is illustrated and described herein as embodied in a method for signal processing for a hearing aid and a corresponding hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Referring now to the figures of the drawings in detail and first, particularly, to FIGS. 2 to 9 thereof, there are seen exemplary embodiments which are described in more detail in the following text and represent preferred embodiments of the present invention.

Figure 1:
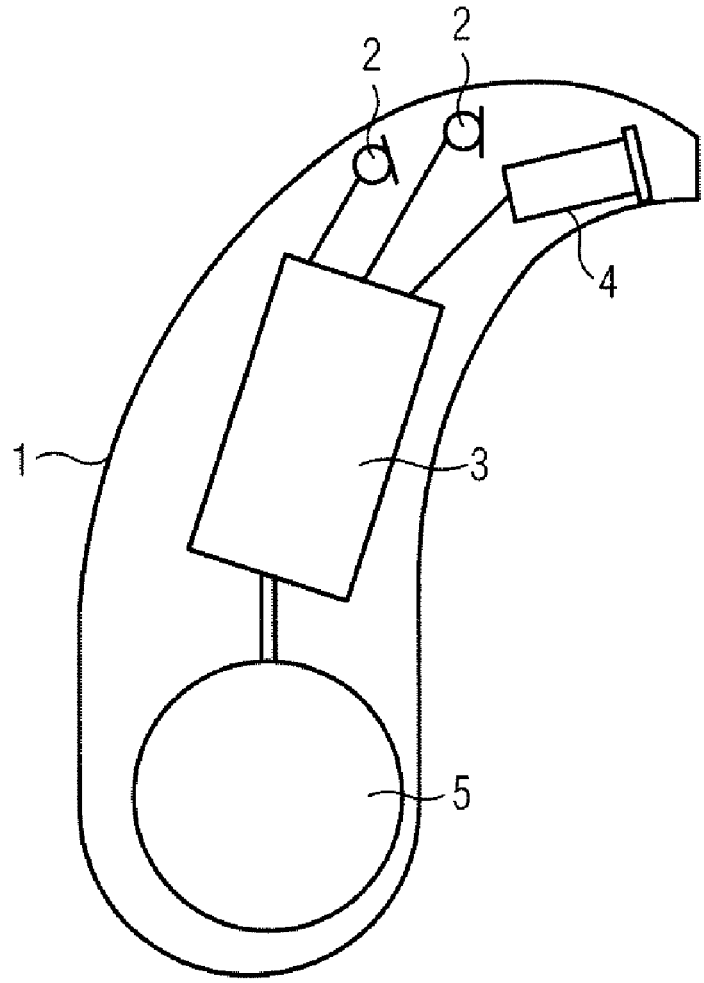
FIG. 1 (Prior Art)
FIG. 1 is a diagrammatic, side-elevational view showing the structure of a hearing aid according to the prior art.
Figure 2:
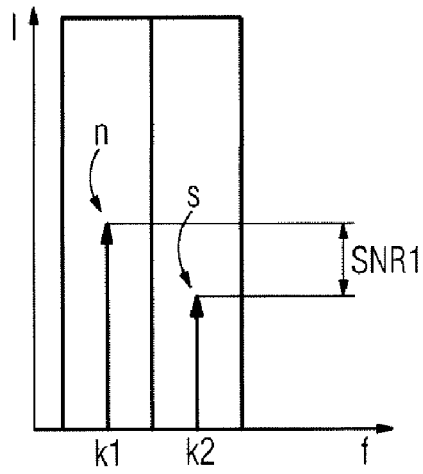
FIG. 2 is a graph showing an input signal of a first or second processing device.
Figure 4:
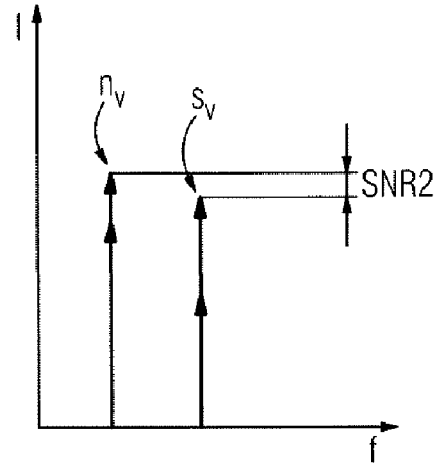
FIG. 4 is a graph showing an output signal of a second processing device.

By way of example, in the case of multichannel compression, the gain of the various signal components may be so unfortunate as a result of the presence of signal components of different intensity in the compression bands, that the spectrum becomes fuzzy and the signal-to-noise ratio (SNR) is thus made worse. That can be seen, by way of example, from FIGS. 2 and 4. FIG. 2 shows a useful signal n in a first channel k1 and a noise signal s in a second channel k2. An intensity I is plotted on the ordinate. The useful signal n and the noise signal s therefore have a signal-to-noise ratio SNR1 as shown. An output signal as shown in FIG. 4 can now be created with the non-linear input signal gain shown in FIG. 2. An amplified useful signal $n_v$ now has only a signal-to-noise ratio SNR2 in comparison to an amplified noise signal $s_v$. In this case, SNR2 is lower than SNR1 (at least on an output-related basis).

Figure 3:
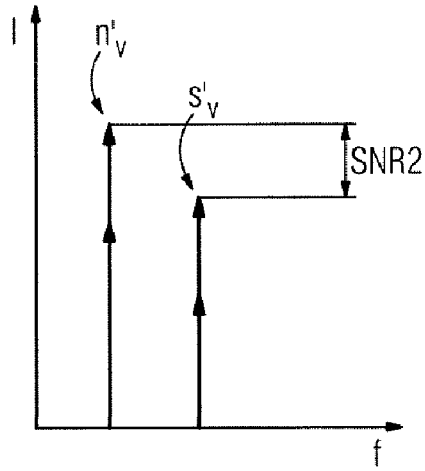
FIG. 3 is a graph showing an output signal of a first processing device.

If, in contrast, the intensity is determined on a broadband basis using a different processing device then, as shown in FIG. 3, this leads to signals $n'_v$ and $s'_v$. This linear gain results in the SNR remaining unchanged. This means that SNR1=SNR2 (on an output-related basis). It can thus be seen that the different processing devices (linear or non-linear gain) can have different effects in the presence of a noisy signal.

Figure 5:
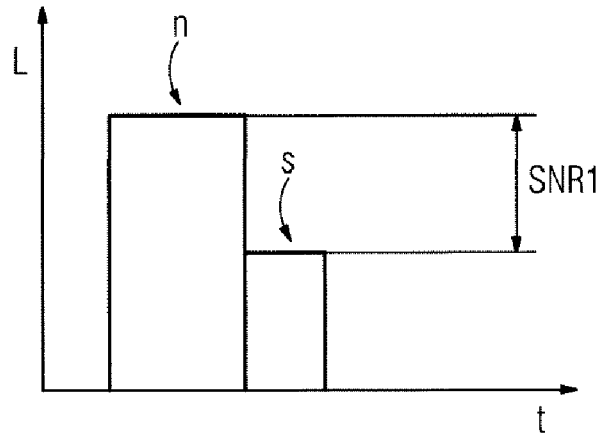
FIG. 5 is a graph showing a further input signal of another first or second processing device.
Figure 7:
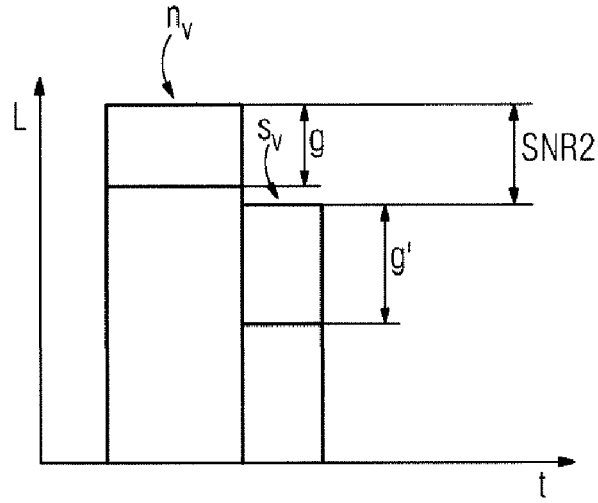
FIG. 7 is a graph showing an output signal of the other second processing device.

Furthermore, a temporal effect also exists, which may likewise result in the SNR deteriorating. In this case, the time constants in fact play a role. For example, as shown in FIG. 5, a noise signal s (for example noise) of lower intensity may occur after a useful signal n (for example a speech signal). FIG. 5 shows a respective level L as a function of time t. The signal-to-noise ratio is SNR1. If now, as shown in FIG. 7, the useful component is first amplified through the use of a very fast time constant to form an amplified useful signal $n_v$, but the lower-energy noise is subsequently applied with a higher gain, resulting in an amplified noise signal $s_v$, then the ratio SNR2 between the useful signal and the noise signal becomes worse. This means that: SNR1>SNR2. This negative effect is exacerbated by the use of short time constants.

Figure 6:
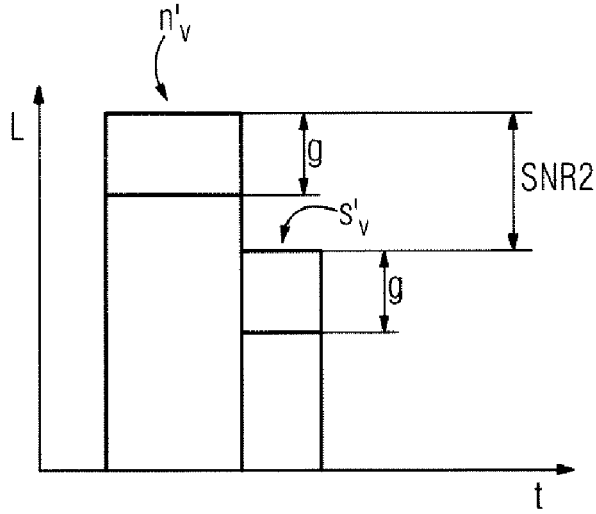
FIG. 6 is a graph showing an output signal of the other first processing device.

If, in contrast, a longer time constant is used in a different processing device as shown in FIG. 6, as a result of which the signals $n'_v$ and $s'_v$ are produced after amplification, then the signal-to-noise ratio SNR2 can be kept constant, that is to say SNR1=SNR2.

It would therefore be desirable for the compression characteristic, the time constants and the level measurement devices being used (narrowband or broadband, input-related or output-related) to be chosen automatically by the system on a situation-dependent basis, in order to automatically ensure the best compression characteristic in the respective acoustic situation for the hearing-aid wearer in this way.

Figure 8:
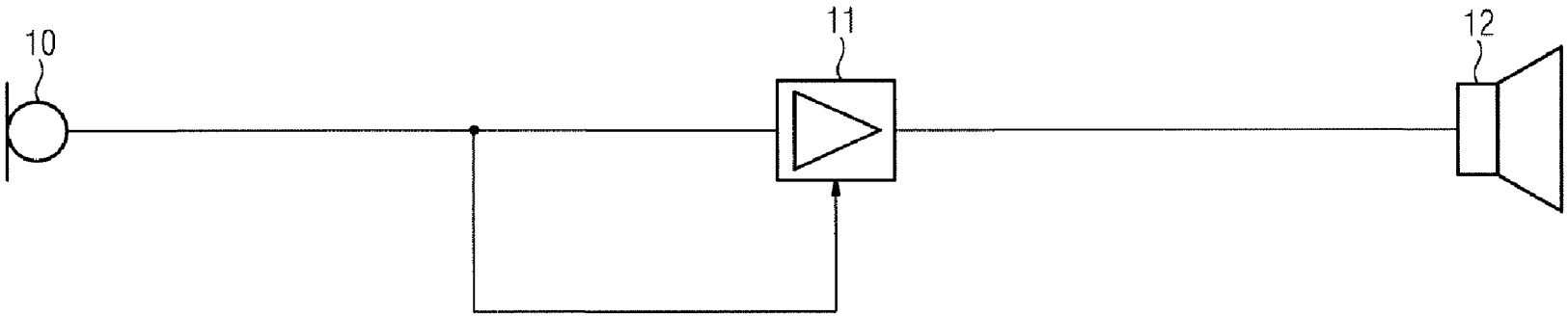
FIG. 8 is a schematic diagram of a circuit for hearing aid gain with input level regulation.

In principle, it is possible either to optimize the compression automatically (possibly at the expense of the SNR) or to use linear gain based on AVC (automatic volume control) for regulation with an output-side level control (the SNR generally remains unchanged. A first alternative (automatic optimization of the compression parameters) can be implemented as shown in FIG. 8. A microphone 10 produces an input signal which is amplified by an amplifier 11. The level of the input signal (situation) is used for control and/or regulation of the amplifier 11. The output signal from the amplifier 11 is passed to an earpiece 12. In addition to amplification, however, the compression rate or a time constant can also be regulated with the aid of the input signal. This makes it possible, for example, to implement a hearing program on a situation-dependent basis in such a way that the compression parameters (gain, compression) are matched to the respective situation. In this case, in an initial stage of the invention, all that would be done is the switching between different compression settings which were previously created during a fine matching process, together with the hearing-aid wearer. However, this system does not change the level measurement device which is used for setting the gain, that is to say there is no switching backwards and forwards between input-related and output-related compression.

Other systems with input-side control could allow situation-dependent selection of the time constants. In this case, the time constants can be determined adaptively in the respective channel, in particular as a function of the (narrowband) level. This counteracts any deterioration in the SNR in the time domain, but spectral fuzziness still remains a problem.

Figure 9:
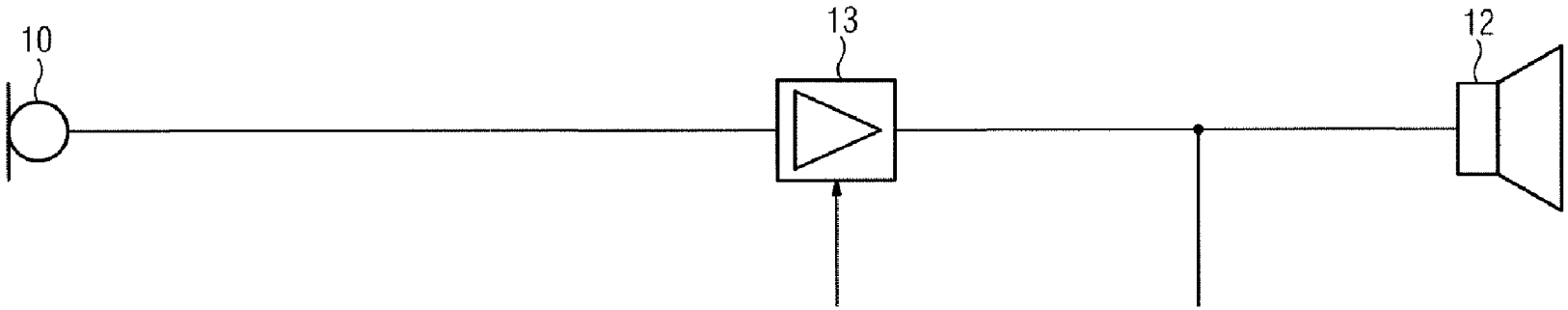
FIG. 9 is a schematic diagram of a circuit for hearing aid gain with output level regulation.

When the overall problem is considered, it is also possible to consider an alternative illustrated in FIG. 9 where the input signal supplied from the microphone 10 is likewise supplied to an amplifier 11, having an output signal which is passed to the earpiece 12. However, in this case, this results in feedback of the output signal from the amplifier 11 and therefore, in particular, in output-side, slow level control. The system in this case acts in a similar manner to AVC with the difference that the resultant frequency-specific gain is determined from complex level statistics in a plurality of bands (for example 128). In this case, not only purely physical factors but also psychoacoustic factors can be taken into account (see the initially cited European Patent Application EP 1 829 028 A1, corresponding to International Publication No. WO 2006/058361 A1). Since the system additionally regulates very slowly and therefore operates linearly within the course of the time constants (several seconds), this makes it possible to achieve a reasonable sound and reasonable volume perception in widely differing acoustic environments. The disadvantage of this system is that, particularly in situations in which the person with impaired hearing still has only a very restricted remaining dynamic range (frequency-dependent difference between the discomfort threshold UCL and the hearing threshold HS) (for example <30 dB), the processed signal cannot be mapped completely onto the dynamic range. This means that speech comprehension, particularly in acoustic situations with background noise, can only be inadequately improved.

Figure 10:
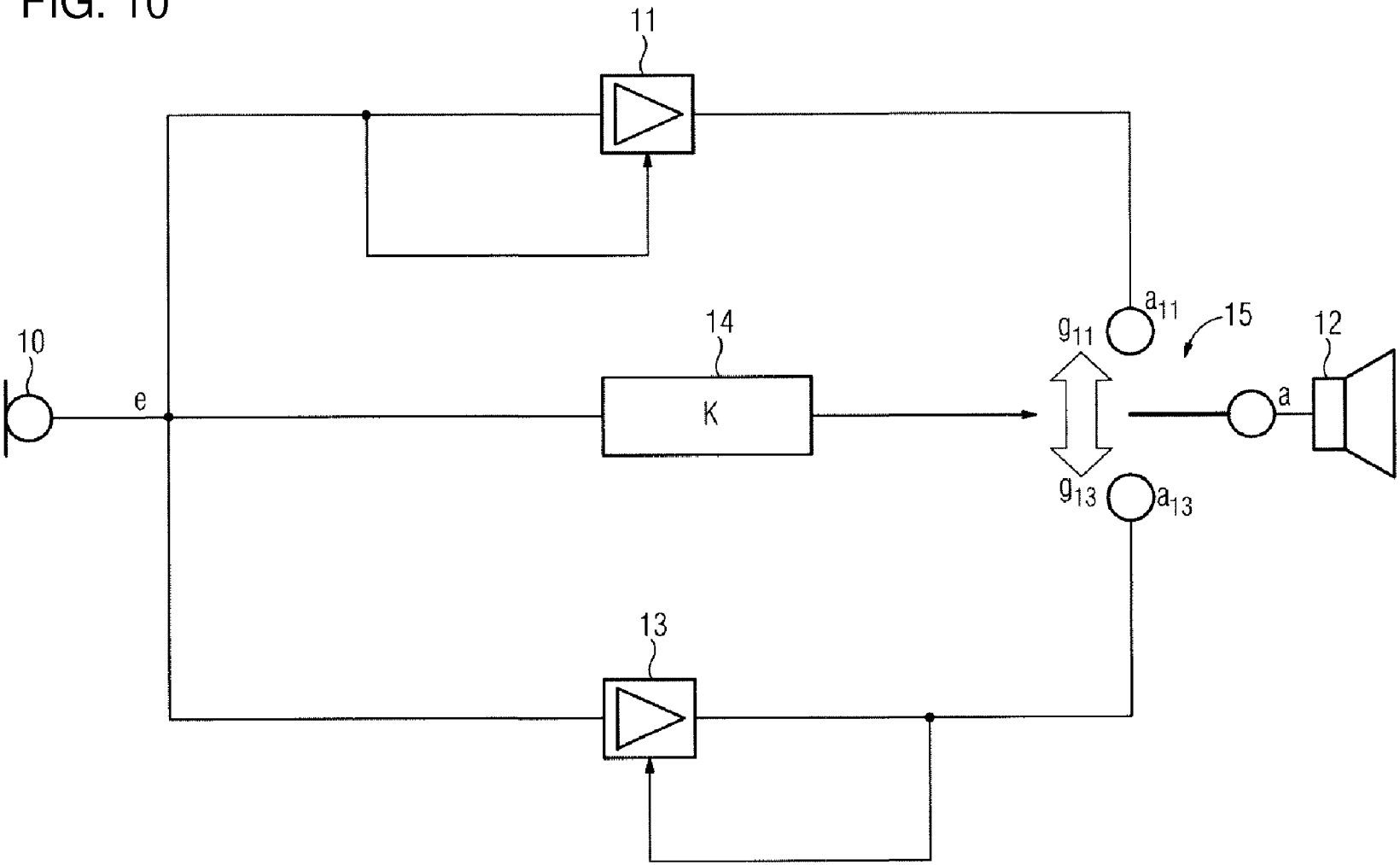
FIG. 10 is a schematic and block diagram of a circuit of a hearing aid according to one embodiment of the present invention.

As the examples given above show, usefulness of the respective system depends on the acoustic situation. The system illustrated in FIG. 10 is therefore provided according to the invention. The input signal, that is to say a signal e produced by the microphone 10, is supplied in a first branch to a first processing device 11, which is controlled by the input signal. A corresponding output signal $a_{11}$ is made available. In a second branch, the input signal e is supplied from the microphone 10 to a second processing device 13, which in this case has output level regulation. An output signal $a_{13}$ is produced there. The input signal e of the microphone 10 is finally passed through a third branch to a classifier 14. A classification result is used in a weighting unit 15 in order to produce appropriate weightings $g_{11}$ and $g_{13}$ for the output signals $a_{11}$ and $a_{13}$. The two output signals $a_{11}$ and $a_{13}$ are linked to the respective weightings $g_{11}$ and $g_{13}$ in the weighting unit 15, as a result of which a mixed output signal a is produced at the output of the weighting unit 15, and is supplied to the earpiece 12. By way of example, the compression rate, the gain or a time constant can be regulated on a situation-dependent basis in the first branch. In contrast, the frequency-dependent gain can be regulated, for example, in the second branch. This allows continuous mixing of two output signals $a_{11}$, $a_{13}$ produced in parallel to be achieved during operation, with the mixture ratio depending on the classification result.

If the algorithm used as the basis for the first processing device 11 is an AGCi (Automatic Gain Control input dependent) and the algorithm used as the basis for the second processing device 13 is an AGCo (Automatic Gain Control output dependent), then the gain in a specific situation may, for example, be calculated up to 70% from the value of the AGCo and up to 30% from the value of the AGCi. By way of example, this makes it possible to avoid hard switching between one of the two systems, and to achieve continuous mixing. In a similar manner, mixed signals including quasi-linear and non-linear compression systems, processing devices with different time constants and/or processing devices with evaluation either of a broadband level measurement device or of a plurality of narrowband level measurement devices, can thus also be implemented. The mixture ratio is in each case governed by the classification system or the classifier 14.

The combination of different systems (first processing device 11 and second processing device 13) makes it possible on one hand to optimize the SNR, which is important for speech understanding, in situations in which speech understanding plays a role. In contrast, in situations in which reasonable volume sensitivity plays a critical role, for example in order to optimize the hearing effort in a noisy environment, the system can switch to a fairly linear system which at the same time sets the basic gain in such a way that the output of the hearing aid is perceived to be reasonable by the individual hearing-aid wearer. If the hearing-aid wearer is in a situation in which the useful signal and the interference noise are in different channels, then the system can automatically switch partially or entirely to evaluation of the broadband level measurement device in order to avoid the gain in the different channels being different, therefore making it possible to keep the SNR constant.

The invention claimed is:

1. A method for processing an input signal to form an output signal in a hearing aid, the method comprising the following steps:

supplying the input signal in a first branch to a first processing device;

processing the input signal in accordance with a first processing algorithm in the first processing device to form a first intermediate signal;

supplying said input signal in a second branch to a second processing device;

processing said input signal in accordance with a second processing algorithm in the second processing device to form a second intermediate signal in parallel with the processing of the input signal in accordance with the first processing algorithm;

passing said input signal through a third branch to a classifier;

classifying said input signal in the classifier; and forming the output signal both from the first and from the second intermediate signals with a mixture ratio dependent on a result of the classifying step.

2. The method according to claim 1, which further comprises carrying out regulation at a level of the input signal in the first processing algorithm, and carrying out regulation at a level of the second intermediate signal in the second processing algorithm.

3. The method according to claim 1, wherein the first and the second processing algorithms are each a compression algorithm.

4. The method according to claim 3, wherein the first processing algorithm is a linear compression algorithm, and the second processing algorithm is a non-linear compression algorithm, at least in a predetermined time period.

5. The method according to claim 1, wherein the first processing algorithm has a first time constant, the second processing algorithm has a second time constant of a type corresponding to that of the first time constant, and the first time constant is not the same as the second time constant.

6. The method according to claim 1, wherein the first processing algorithm is based on a broadband level measurement, and the second processing algorithm is based on a narrowband level measurement.

7. A hearing aid, comprising:

a first branch having a first processing device for processing an input signal in accordance with a first processing algorithm to form a first intermediate signal;

a second branch having a second processing device for processing said input signal in accordance with a second processing algorithm to form a second intermediate signal in parallel with the processing of the input signal in accordance with the first processing algorithm;

a third branch having a classification device for classification of said input signal; and a third processing device for forming an output signal both from the first and from the second intermediate signals with a mixture ratio dependent on a result of the classification.

8. The hearing aid according to claim 7, wherein a level of the input signal is used for regulation in said first processing device, and a level of the second intermediate signal is used for regulation in said second processing device.

9. The hearing aid according to claim 7, wherein the first and the second processing algorithms are each a compression algorithm.

10. The hearing aid according to claim 7, wherein said first processing device has a level measurement device for broadband level measurement, and said second processing device has a level measurement device for narrowband level measurement.

* * * * *